US005353892A

United States Patent [19]

Lu

[11] Patent Number: 5,353,892

[45] Date of Patent: Oct. 11, 1994

[54] LADDER JOINT FOR A FOLDING COLLAPSIBLE LADDER

[76] Inventor: Feng-Hui Lu, No. 8, Alley 8, Lane 136, Yu-Le Rd., Kaohsiung, Taiwan

[21] Appl. No.: 136,124

[22] Filed: Oct. 14, 1993

[51] Int. Cl.[5] ..... E06C 1/28

[52] U.S. Cl. ..... 182/163; 403/96; 16/328; 182/22; 182/27

[58] Field of Search ..... 182/183, 22, 21, 164, 182/27, 24; 16/328, 331, 334, 326, 324; 403/325, 106, 108, 104, 96, 97

[56] References Cited

U.S. PATENT DOCUMENTS 579,277 3/1897 Lord ..... 403/96

1,092,447 4/1914 Leland ..... 403/96 X 4,666,327 5/1987 Su ..... 182/24

4,890,950 1/1990 Yoo ..... 16/328

*Primary Examiner*—Alvin C. Chin-Shue

*Attorney, Agent, or Firm*—Varndell Legal Group

[57] ABSTRACT

A ladder joint includes a pivot, a first base plate mounted on the pivot and connected to a first side rail section of one side rail of a ladder, a second base plate mounted on the pivot and connected to a second side rail section of the side rail, a spring-supported lever pivoted to the pivot, a lock bolt inserted through an eccentric hole on the second base plate and controlled by the lever to engage into either of a series of eccentric holes on the first base plate.

1 Claim, 5 Drawing Sheets

LADDER JOINT FOR A FOLDING COLLAPSIBLE LADDER

BACKGROUND OF THE INVENTION

The present invention relates to folding collapsible ladders, and more specifically relates to a safety ladder joint for a folding collapsible ladder.

Various ladders have been disclosed, and have appeared on the market. FIG. 1 shows a twin-step step ladder according to the prior art. This structure of step ladder needs much storage space, and is inconvenient to carry. FIG. 1 shows a folding collapsible step ladder according to the prior art. Although this folding collapsible step ladder needs less storage space, it is still inconvenient to carry. In this structure of folding collapsible step ladder, the joints between side rail sections may wear out quickly, causing the ladder unstable. Further, this structure of folding collapsible step ladder is complicated to assemble and dismount.

SUMMARY OF THE INVENTION

It is one object of the present invention to provide a ladder joint for a folding collapsible ladder which eliminates the aforesaid disadvantages. It is another object of the present invention to provide a ladder joint for a folding collapsible ladder which is safe in use. It is another object of the present invention to provide a ladder joint for a folding collapsible ladder which is easy to operate. According to the preferred embodiment of the present invention, the ladder joint is comprised of a pivot, a first base plate mounted on the pivot and connected to a first side rail section of one side rail of a ladder, a second base plate mounted on the pivot and connected to a second side rail section of the side rail, a spring-supported lever pivoted to the pivot, a lock bolt inserted through an eccentric hole on the second base plate and controlled by the lever to engage into either of a series of eccentric holes on the first base plate. The fist and second base plates are respectively molded from glass fibers, therefore they are corrosion protective, acid protective, and alkali protective, and they are not electrically conductive. Because the fist and second base plates are molded from glass fibers, the manufacturing cost of the ladder joint can be greatly reduced through a mass production process.

DETAILED DESCRIPTION OF THE PREFERRED EMBODIMENT

Figure 2:
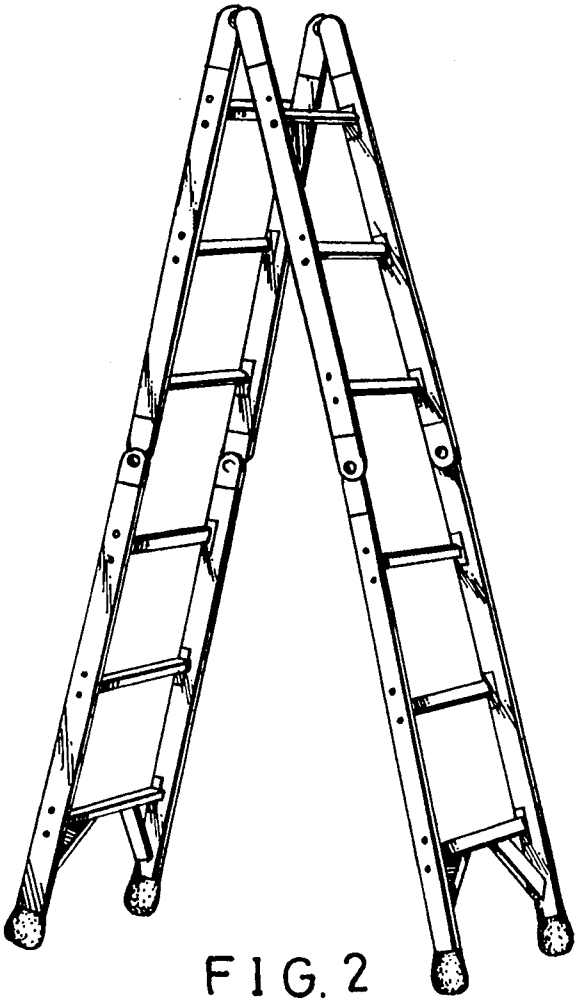
FIG. 2 PRIOR ART
FIG. 2 is an elevational view of a folding collapsible step ladder according to the prior art.
Figure 1:
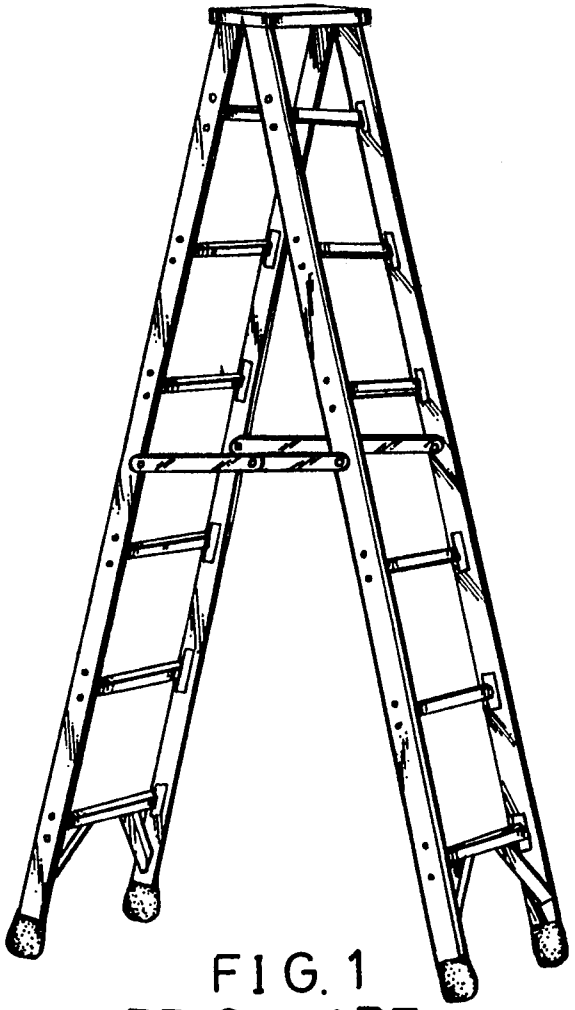
FIG. 1 PRIOR ART
FIG. 1 is an elevational view of a twin-step type step ladder according to the prior art.
Figure 3:
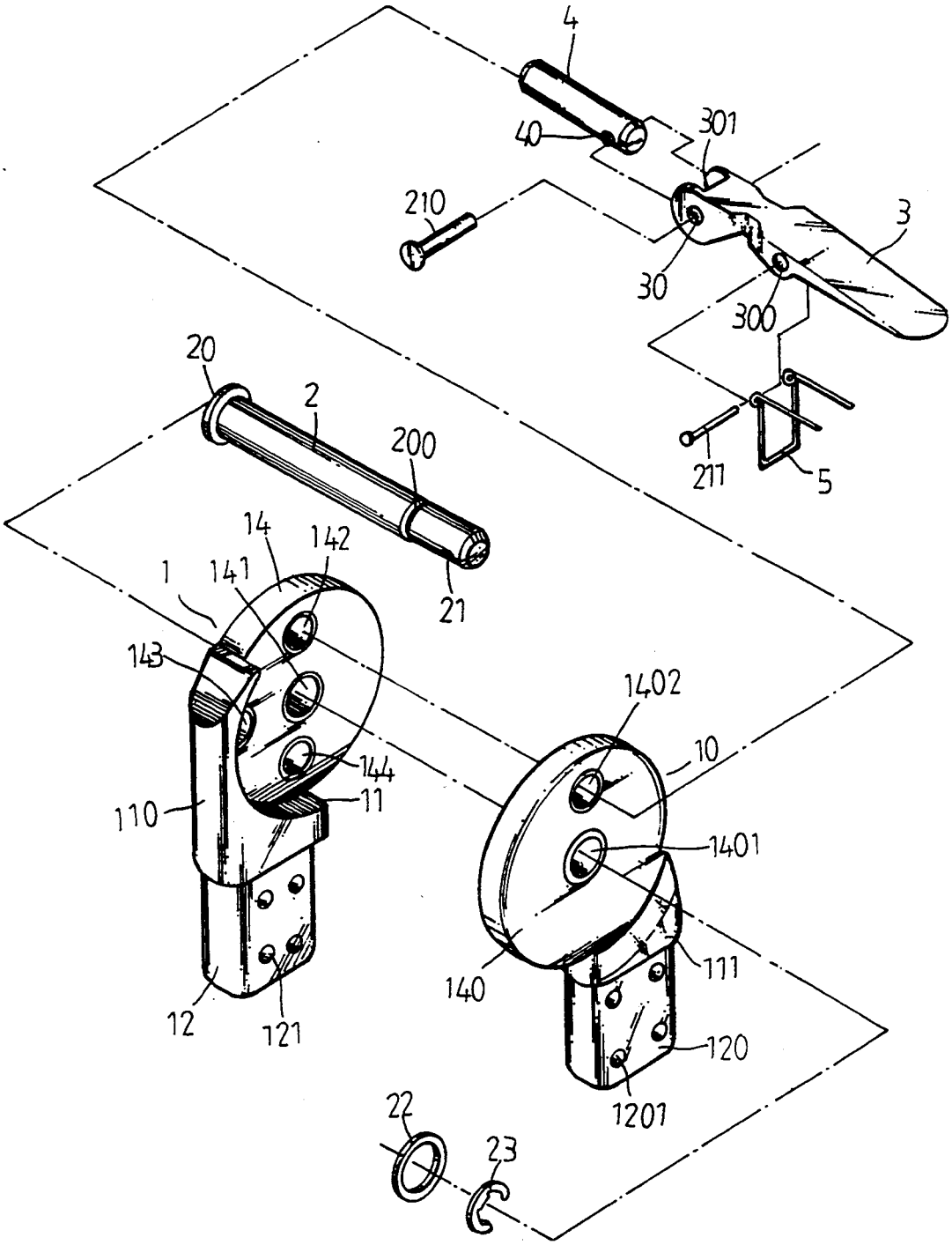
FIG. 3 is an exploded view of a ladder joint according to the preferred embodiment of the present invention.
Figure 4:
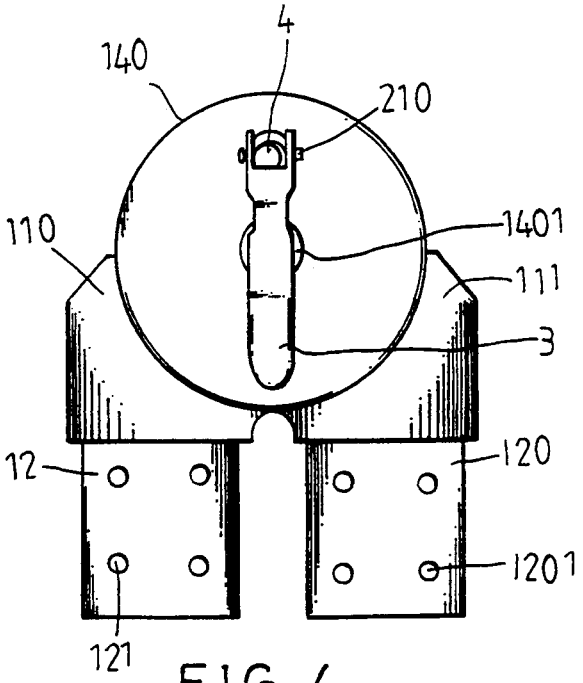
FIG. 4 is an assembly view in plain of the ladder joint of FIG. 3.
Figure 5:
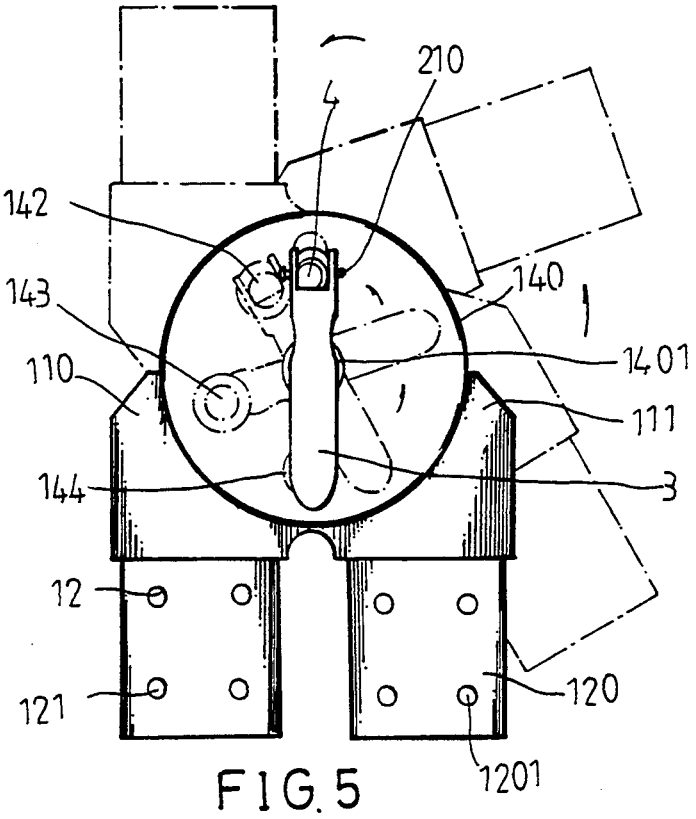
FIG. 5 shows the lever of the ladder joint rotated to change the angular position.
Figure 7:
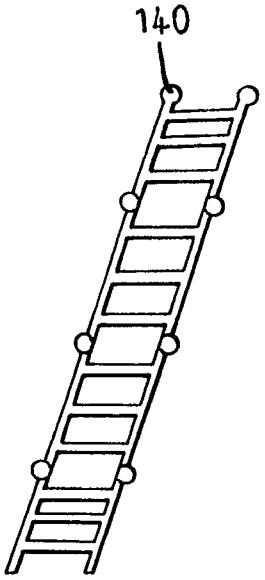
FIG. 7 illustrates a folding collapsible ladder made according to the present invention.
Figure 6:
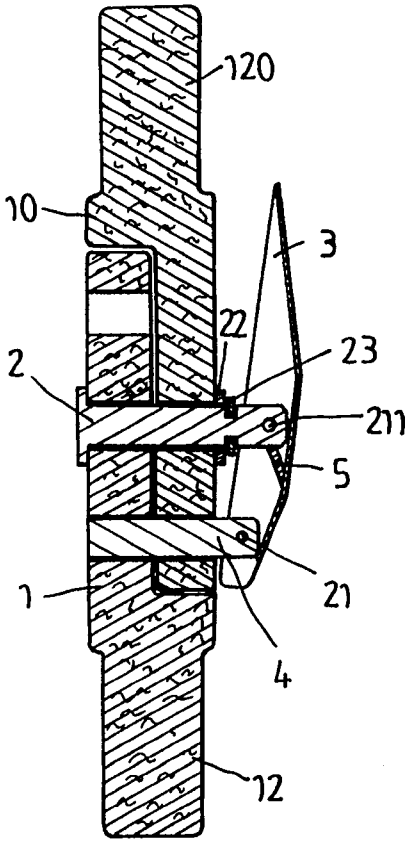
FIG. 6 is a longitudinal view in section of the ladder joint of FIG. 3.

Referring to FIGS. 3, 4, 5, and 6, a ladder joint in accordance with the preferred embodiment of the present invention is generally comprised of a first base plate 1 and a second base plate 10 respectively made of glass fibers in the shape of the English character "P", a pivot 2, a lever 3, and a lock bolt 4. Each base plate 1 or 10 is comprised of a circular connecting portion 14 or 140 at one end, a socket portion 12 or 120 at an opposite end, and a substantially L-shaped block 110 or 140 therebetween. The circular connecting portion 14 of the first base plate 1 comprises a center through hole 141, and a plurality of eccentric holes 142;143;144 spaced around the center through hole 141. The circular connecting portion 14 of the second base plate 10 comprises a center through hole 140 pivotably connected to the center through hole 141 on the circular connecting portion 14 of the first base plate 1 by a pivot 20, and an eccentric hole 1402 near the border alternatively connected to either eccentric hole 142, 143 or 144 on the circular connecting portion 14 of the first base plate 1 by the lock bolt 4. The socket portion 12 or 120 comprises pairs of through holes 121 or 1201 through which respective screws are threaded to connect the socket portion 12 or 120 of the respective base plate 1 or 10 to a respective side rail section of either side rail of a folding collapsible ladder. The pivot 2 is made in a cylindrical shape comprising a head 20 on one end thereof, a pivot hole 21 near an opposite end thereof, and an annular groove 200 near the pivot hole 21. After the pivot 2 was inserted through the center through holes 141;1401 of the first and second base plates 1;10, a clamp 23 is clamped on the annular groove 200 of the pivot 2 with a rubber ring 22 is mounted around pivot 2 and retained between the clamp 23 and the second base plate 10, and therefore the first and second base plates 1;10 are pivotably fastened to the pivot 2 and retained between the head 20 of the pivot 2 and the rubber ring 22. The lock bolt 4 comprises a pivot hole 40 near a rear end thereof. The lever 3 comprises a front notch 301, two opposite pivot holes 30 aligned at two opposite sides by the front notch 301, two opposite pin holes 300 bilaterally disposed in the middle respectively connected to the pivot hole 21 on the pivot 2 at two opposite ends by a pivot pin 211. A spring 5 is mounted on the pivot pin 211 and retained to the lever 3. The lock bolt 4 is pivoted to the lever 3 by inserting the rear end of the lock bolt 4 into the front notch 301 of the lever 3 and then inserting a pivot pin 210 through the pivot holes 30 on the lever 3 and the pivot hole 40 on the lock bolt 4.

Figure 8:
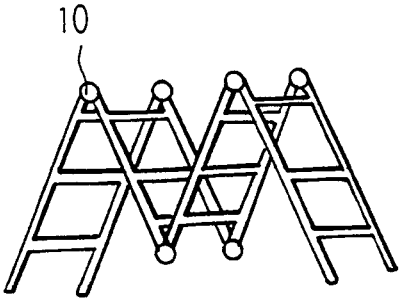
FIG. 8 illustrates the folding collapsible ladder of FIG. 7 arranged into an alternate form.
Figure 9:
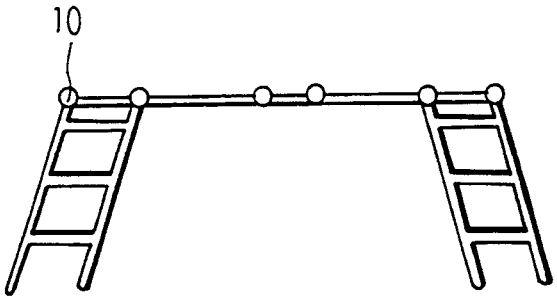
FIG. 9 illustrates the folding collapsible ladder of FIG. 7 arranged into another alternate form.
Figure 10:
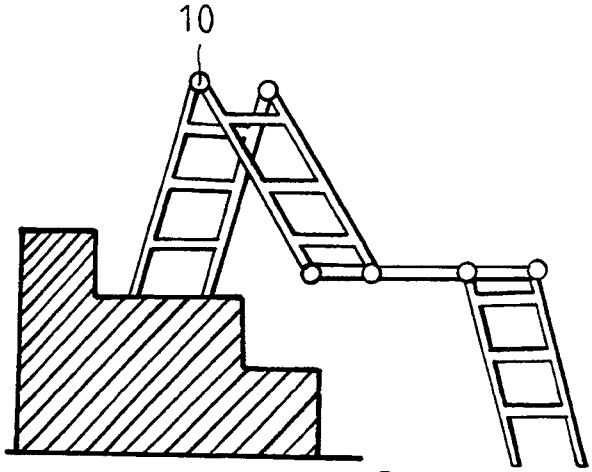
FIG. 10 illustrates the folding collapsible ladder of FIG. 7 arranged into still another alternate form.

Referring to FIGS. 5 and 6 again, the spring 5 gives a pressure to the lever 3, causing the lock bolt 4 to be retained in the locking position to lock the first and second base plates 1;10 in the selected position. The positions of the first and second base plates 1;10 can be changed relative to each other (see FIGS. 8, 9, and 10). Changing the angular position of one base plate relative to the other base plate is easy. As the lever 3 is pressed, the lock bolt is released from the circular connecting portion 14 of the first base plate 1, then the lever 3 can be rotated to move the lock bolt 4 from one eccentric hole on the first base 1 to another. When aligned, the lever 3 is released from the hand, and therefore the spring 5 automatically pushes the lever 3 back, causing the lock bolt 4 to engage into the selected eccentric hole on the circular connecting portion 14 of the first base plate 1.

I claim:

1. A ladder joint comprising:

a first base plate molded from glass fibers, said first base plate comprising a circular connecting portion at one end, a socket portion at an opposite end fastened to a first side rail section of one side rail of a folding collapsible ladder, and a substantially L-shaped block therebetween, the circular connecting portion of said first base plate comprising a center through hole, and a plurality of eccentric holes spaced around the border;

a second base plate molded from glass fibers, said second base plate comprising a circular connecting portion at one end, a socket portion at an opposite end fastened to a second side rail section of said side rail of said folding collapsible ladder, and a substantially L-shaped block therebetween, the circular connecting portion of said second base plate comprising a center through hole, and an eccentric hole near the border;

a pivot inserted through the center through holes on said first and second base plates to connect them together for permitting said first and second sections of said side rails to be respectively pivoted about said pivot;

a lever having a middle part pivotably connected to said pivot by a first pin;

a lock bolt having one end pivotably connected to one end of said lever by a second pin, and an opposite end inserted through the eccentric hole on said second base plate into either eccentric hole on said first base plate; and spring means mounted on said first pin and retained to said lever, said spring means giving a pressure to said lever for permitting said lock bolt to be retained engaged into either eccentric hole on said first base plate;

whereby said lock bolt is released from one eccentric hole on said first base plate and then engaged into another eccentric hole on said first base plate to change the angular positions of said first and second sections relative to each other by pressing said lever and then rotating said lever on said second base plate.

* * * * *